US008998738B1

(12) United States Patent
Dillon et al.

(10) Patent No.: US 8,998,738 B1
(45) Date of Patent: Apr. 7, 2015

(54) SYSTEMS AND METHODS FOR TRAINING GOLF SWINGS

(71) Applicant: Align-A-Shot LLC, Harrisburg, PA (US)

(72) Inventors: Michael A. Dillon, Harrisburg, PA (US); Paul E. Deraval, Garden City, NY (US)

(73) Assignee: Align-A-Shot, LLC, Harrisburg, PA (US)

( * ) Notice: Subject to any disclaimer, the term of this patent is extended or adjusted under 35 U.S.C. 154(b) by 0 days.

(21) Appl. No.: 14/178,240

(22) Filed: Feb. 11, 2014

Related U.S. Application Data

(60) Provisional application No. 61/770,247, filed on Feb. 27, 2013.

(51) Int. Cl.
*A63B 69/36* (2006.01)

(52) U.S. Cl.
CPC ..... *A63B 69/3667* (2013.01); *A63B 69/3661* (2013.01); *A63B 2243/0029* (2013.01)

(58) Field of Classification Search
USPC ..... 473/157, 218, 290, 266, 270, 409, 278
See application file for complete search history.

(56) References Cited

U.S. PATENT DOCUMENTS

| | | | | |
|---|---|---|---|---|
| 3,580,584 | A * | 5/1971 | Trosko | 473/218 |
| 5,139,263 | A | 8/1992 | Feo | |
| 6,945,875 | B2 * | 9/2005 | Gauer | 473/270 |
| 7,090,599 | B2 * | 8/2006 | Hedgepath | 473/452 |
| 7,131,910 | B2 * | 11/2006 | Townsend, II | 473/278 |
| 2007/0173339 | A1 * | 7/2007 | Rivard | 473/266 |

* cited by examiner

*Primary Examiner* — Nini Legesse
(74) *Attorney, Agent, or Firm* — Mahamedi Paradice LLP

(57) ABSTRACT

Systems and methods are provided for training golf swings. A device may be provided with a visual guide that assists golfers with practicing different shot types. The visual guide may include one or more shot arrow and corresponding clubface lines for different types of shots. The visual guide may also include one or more alignment indicators which may be used by the golfer to orient the golfer's stance. The device may be a portable mat, and its position may be adjustable to orient the mat for different shot types.

8 Claims, 6 Drawing Sheets

SYSTEMS AND METHODS FOR TRAINING GOLF SWINGS

CROSS-REFERENCE

This application claims the benefit of U.S. Provisional Application No. 61/770,247, filed Feb. 27, 2013, which application is incorporated herein by reference in its entirety.

BACKGROUND OF THE INVENTION

While it is common knowledge that proper alignment, having a square clubface to the target, ball position, and a straight swing path are the key mechanical fundamentals to a successful golf swing, many golfers struggle to put all these elements together to consistently achieve desired shots. If a golfer does not have these fundamentals correct, their swing will evolve, but in a negative way. As time goes on, these improper modifications ingrain in ones swing and become more and more difficult to correct over time.

Furthermore, many golfers are unaware and intimidated to learn how to properly achieve more advanced shot types such as a fade or draw. A golfer of any skill level can greatly benefit if they have an in-depth understanding of the factors that affect ball flight. In particular, the influence of stance, ball position, clubface orientation and swing path on ball flight. Ball flight laws have great relevance for golfers who deliberately want to create a certain ball flight pattern (high fade, mid-height fade, low fade, high straight, mid-height straight, low straight, high draw, mid-height draw, low draw, high hook, mid-height hook, low hook, high slice, mid-height slice, low slice) or who want to understand why they have a non-deliberate predisposition to a particularly undesirable ball flight pattern (e.g., push-sliced shots or snap-hook shots). One cannot hope to fruitfully change one's swing if one does not correctly identify the primary problems causing an undesirable ball flight pattern. A slice is the most common problem for recreational golfers and understanding how to intentionally hit one as well as hitting the inverse shot (a hook) can greatly help the golfer correct their swing. A fade, however, is often a shot played intentionally and is even the preferred ball flight for some of the best golfers in history (Jack Nicklaus and Ben Hogan, among others, preferred to play a fade).

Traditionally, various attempts have been made for a golf swing training device to address a golfer's common flaws and to develop proper alignment. See U.S. Pat. No. 5,139,263 which is hereby incorporated by reference in its entirety. Such previous systems used a stationary framed device with color coded rods protruding from the frame that provide guidelines for different body alignment positions. The user's stance varies relative to the borders of the frame for different types of shots. The solid framed device folds in half.

In another example, a previous system was developed where a shape for a desired shot is practiced by swinging along labeled curved lines on a mat, where the mat does not move, but the swing plane does. See U.S. Pat. No. 7,131,910 which is hereby incorporated by reference in its entirety. For a golfer's footprint, the target curve stays the same, and a separate foot and ball position guide component is provided. The mat is formed from a rigid, solid material.

While these devices are helpful in some respects, they fall short on teaching the golfer how to achieve all the various horizontal and vertical ball flight trajectories while using a consistent swing path.

Therefore, a need exists for improved systems and methods for teaching a golfer how to achieve proper swing technique, alignment, and various horizontal and vertical ball flight patterns.

SUMMARY OF THE INVENTION

Based on golfs core principles of alignment, consistent swing path, ball position, and having a square clubface to target, systems, methods, and devices herein address the areas which create the most common mistakes and errors in a golfer's swing. If these fundamentals are lacking, a golfer's swing will adapt and evolve in a negative way. As time goes on, these improper modifications ingrain in one's swing and become more and more difficult to correct over time. With the systems, methods, and device provided herein, a golfer builds a strong/proper foundation on which he or she builds the correct swing. In addition, this device teaches the core mechanics behind basic and advanced shot types.

As the fundamentals are ingrained with proper training while using the device, golfers can also correct their flaws. For example—if a golfer has a slice, setup for a draw or even a hook. The golfer can begin to feel the sensation of negating/reversing the unwanted shot. The systems and methods provided herein provide a mechanism by which a golfer can set up for different types of shots while maintaining a consistent swing path.

When the golfer becomes more advanced, they can begin to implement controlled shot making. Playing a "fade" and a "draw" is the way advanced golfers navigate the golf course and this device is able to teach a player at any level how to achieve these types of shots. The mat provided herein provides a simple vehicle through which a golfer can practice different types of shots while developing positive habits that translate to a more natural experience as one would experience on a golf course. Additionally, the mat is also portable, which encourages a user to bring it to practice.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

The invention provides systems and methods for training golf swings in accordance with aspects of the invention. Various aspects of the invention described herein may be applied to any of the particular applications set forth below or for any other types of physical motions. The invention may be applied as a standalone system or method, or as part of a system that trains an individual to play golf. It shall be understood that different aspects of the invention can be appreciated individually, collectively, or in combination with each other.

The invention specifically teaches proper alignment, ball position, clubface orientation and swing path for both straight and advanced ball flight patterns in a concise visual format through a ground based reference system.

Figure 1A:
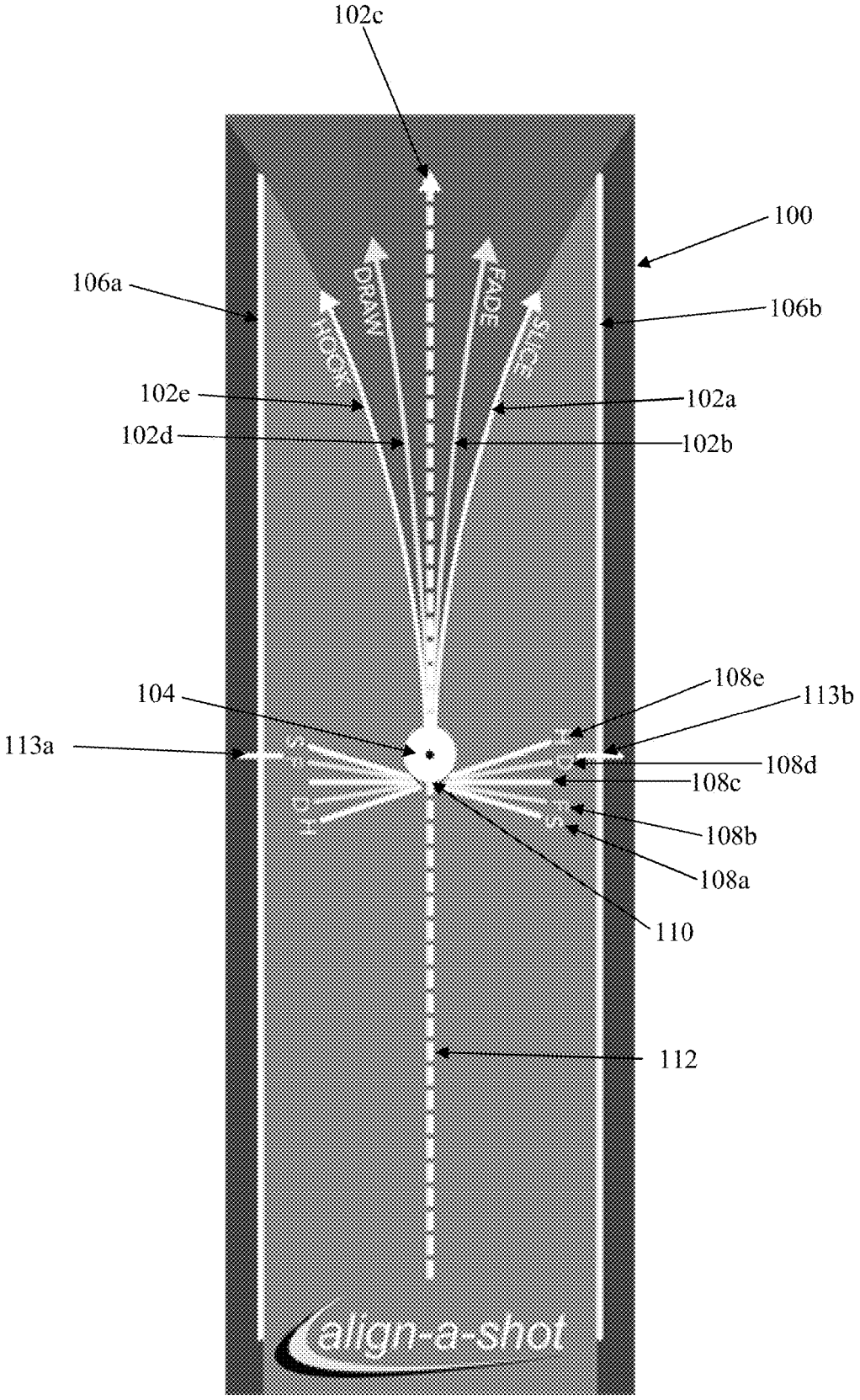
FIG. 1A shows an example of a visual guide useful for assistance in training golf swings, in accordance with an embodiment of the invention.

FIG. 1A shows an example of a visual guide useful for assistance in training golf swings, in accordance with an embodiment of the invention. The visual guide 100 may be located on a mat that include one or more of the following elements: shot type arrows 102*a*, 102*b*, 102*c*, 102*d*, 102*e* which may be used to align desired "shot" type to a target. One or more outer alignment guides 106*a*, 106*b* may be presented, with which a golfer may align feet, hips, and/or shoulders so that they are parallel to the guides. A number of clubface lines 108*a*, 108*b*, 108*c*, 108*d*, 108*e* may correspond with and work together with shot type arrows, and may be used so that the golfer aligns a clubface with a selected club face line matching the desired shot type. A shot type arrow may be combined with a clubface line to provide a "T" shaped alignment guide that points in different directions and at different angles relative to the outer alignment guides.

The visual guide may also include a swing line 112 that represents a golfer's swing path which the golfer swings straight through. The swing line 112 may be substantially parallel to the outer alignment guides. A center swing line may be included that is represented by a solid line, or preferably a dashed line that is more easily distinguished from the outer alignment guides which may be represented by one or more solid lines. In addition, a ball marker or tee 104 may also be provided upon the mat which the golfer is to place a golf ball before swinging. The visual guide may be provided on a support, such as a mat, or be integral to an underlying surface. The visual guide may be provided on a mat or other support that may rest upon an underlying surface and/or be movable relative to the underlying surface. The support (and visual guide) may be turned or rotated by the golfer so the desired shot type arrow is aimed at a desired target. For example, if a golfer wants to hit a draw, they may rotate the entire device until the shot type arrow for a "DRAW" is pointing at the desired target.

The visual guide 100 may have one or more shot type arrows 102*a*, 102*b*, 102*c*, 102*d*, 102*e*. Any number of shot type arrows (e.g., 1, 2, 3, 4, 5, 6, 7, 8, 9, 10, or more) differentiating different types of golf shots, including relative varying degrees thereof, may be provided. Examples of shot types may include hook, draw, straight, face, and slice, including relative varying degrees thereof. One or more arrow may be provided for each type of golf shot, such as a hook arrow, draw arrow, straight arrow, fade arrow, and slice arrow.

Optionally, labels may be provided on the visual guide for one or more of the shot type arrows. A golfer may align a desired shot to a target. For example, if a golfer wants to practice a golfer's slice shot, the golfer may aim the visual guide so that the "SLICE" arrow 102*a* is directed at the target. If a golfer wants to practice a draw shot, the golfer may adjust the position of the visual guide so that the "DRAW" arrow 102*d* is aimed at the target.

In some instances, the shot type arrows may be arranged so that they are spaced any number of degrees apart from one another. They may be spaced the same degrees apart from one another or varying degrees. In one example, they may be spaced greater than, less than, and/or equal to about 3 degrees, 4 degrees, 5 degrees, 6 degrees, 7 degrees, 8 degrees, 9 degrees, 10 degrees, 12 degrees, or 15 degrees relative to one another.

The shot type arrows 102*a*, 102*b*, 102*c*, 102*d*, 102*e* may have one or more arrow head, or may be lines that do not need an arrow head. Any description herein of shot type arrows may or may not include arrow heads. In some instances the shot type arrows may include solid straight lines, arced lines, curved lines, dotted lines, and/or dashed lines. The shot type arrows may have the same thickness as one another, or may have different thicknesses. The shot type arrows may be of the same color, or may be of different colors. The shot type arrows may be of the same length or may be of different lengths. For instance, a straight arrow may be longer than a hook, draw, face, or slice arrow.

One or more shot type arrows 102*a*, 102*b*, 102*c*, 102*d*, 102*e* may converge at a central point, which may be a ball marker 104. A visual indicator may be provided for the central point. The visual indicator may have any shape, such as a circle, cross-hair, ellipse, triangle, square, or any other shape. The shape may be approximately sized similar to a golf ball, or any other size. The central point may be designed to be representative of a golf ball resting on the central point, or provide a ball marker. A ball marker may be a location where a ball can be placed. In some instances, the shot type arrows end at the central convergence point and do not extend beyond the central convergence point. The shot type arrows may all radiate from the central convergence point towards the same side of the visual guide. Alternatively, the shot type arrows may extend beyond the central point and/or point toward different sides of the visual guide. In some instances, one or more of the shot type arrows (e.g., a straight arrow 102*c*) may extend beyond the central point while one or more of the other shot type arrows (e.g., slice arrow 102*a*, face arrow 102*b*, draw arrow 102*d*, and hook arrow 102*e*) do not extend beyond the central point.

One or more alignment arrows/indicators 106*a*, 106*b* may be provided on the visual guide. The alignment arrows may be parallel to a straight arrow 102*c* and/or one another. For example, two alignment arrows may be provided with a central point 104 and/or straight arrow 102*c* between them. The alignment arrows may or may not be parallel to an edge of a visual guide, such as an edge of the mat. The alignment arrows may or may not include an arrow head. In some instances, an arrow head may be provided indicating the direction that a golfer may be hitting a ball. Any description herein of alignment arrows may or may not include arrow heads. Any form of alignment indicator may be used. In some instances the alignment arrows may include solid lines, dotted lines, and/or dashed lines. The alignment arrows may have the same thickness as one another, or may have different thicknesses. The alignment arrows may be of the same color, or may be of different colors. The alignment arrows may be of the same length or may be of different lengths. In some instances, the alignment arrows may extend along an entire length or a large part of the length of the visual guide. For instance, the alignment arrows may extend along 75% or more, 80% or more, 85% or more, 90% or more, 95% or more of the length of the visual guide. The alignment arrows may be useful for aligning a golfer's feet, hips, and shoulders parallel to the alignment arrows. Thus, the alignment arrows may indicate a parallel stance for a golfer. In some instances, the alignment arrows may indicate a line from which a golfer's feet are to be equidistant.

A visual guide may also include one or more clubface lines 108*a*, 108*b*, 108*c*, 108*d*, 108*e*. Any number of club face lines (e.g., 1, 2, 3, 4, 5, 6, 7, 8, 9, 10, or more) differentiating club faces for different types of golf shots may be provided. The number of club face lines may or may not equal the number of shot type arrows. In some embodiments, each of the club face lines may correspond to and perpendicular relative each of the shot type arrows (e.g., one to one correspondence). Examples of shot types may include hook, draw, straight, face, and slice. One or more clubface line may be provided for each type, such as a hook clubface line, draw clubface line, straight clubface line, fade clubface line, and slice clubface line. Optionally, labels or abbreviated labels may be provided on the visual guide for one or more of the clubface lines. A golfer may align a golfer's clubface with the appropriate clubface line. For example, if a golfer wants to practice a golfer's slice shot, in addition to adjusting the visual guide so that a slice arrow 102*a* is directed to a target, the golfer may align the golfer's clubface to the slice clubface line 108*a* is directed at the target. If a golfer wants to practice a draw shot, the golfer may adjust the position of the visual guide so that the draw arrow 102*d* is aimed at the target and align the golfer's clubface to the draw clubface line 108*d*.

The clubface lines 108*a*, 108*b*, 108*c*, 108*d*, 108*e* may or may not have one or more arrow head. Any description herein of clubface lines may or may not include arrow heads. In some instances the clubface lines may include solid lines, dotted lines, and/or dashed lines. The clubface may have the same thickness as one another, or may have different thicknesses. The clubface lines may be thinner than, have the same thickness as, or be thicker than shot type arrows. The clubface lines may be of the same color, or may be of different colors. In some instances, a clubface line may be the same color as a corresponding shot type arrow. For example, a slice clubface line 108*a* may be the same color as a slice arrow 102*a*. The clubface lines may be of the same length or may be of different lengths. In some instances, the clubface lines may be shorter than shot arrows. The clubface lines may be oriented perpendicular to their respective shot arrows. For example, a slice clubface line may be perpendicular to a slice arrow, a fade clubface line may be perpendicular to a fade arrow, a straight clubface line may be perpendicular to a straight arrow, a draw clubface line may be perpendicular to a draw arrow, and/or a hook clubface line may be perpendicular to a hook arrow.

One or more clubface lines 108*a*, 108*b*, 108*c*, 108*d*, 108*e* may converge at the central point/ball marker 104. In some instances, the clubface lines extend on both sides of the central convergence point. Alternatively, the clubface lines end at the central convergence point. The clubface lines may intersect at a point on a side of a ball marker. For example, the clubface lines may intersect at a location behind the ball marker 110. This may be representative of the club resting behind the ball, relative to the target.

The visual guide may also include a swing line 112. The swing line may represent a golfer's swing plane. The gofer may swing straight back and straight forward/through. In some instances, even if a clubface is aligned with one or more various clubface lines 108*a*, 108*b*, 108*c*, 108*d*, 108*e* the golfer may still try to swing through the swing line. Thus, the golfer's club face may or may not be perpendicular to the swing line. In some instances (e.g., slice, fade, draw, or hook) the visual guide may be presented so that the club face line (and thus the face of the golfer's club) is not parallel to the swing line. The swing line may be parallel to one or more alignment arrows 106*a*, 106*b*. In some instances, the swing line may be parallel to a straight arrow 102*c*. The swing line may extend beyond the straight arrow or be collinear with straight arrow. The swing line may be perpendicular to a straight clubface line 108*c*.

Figure 1B:
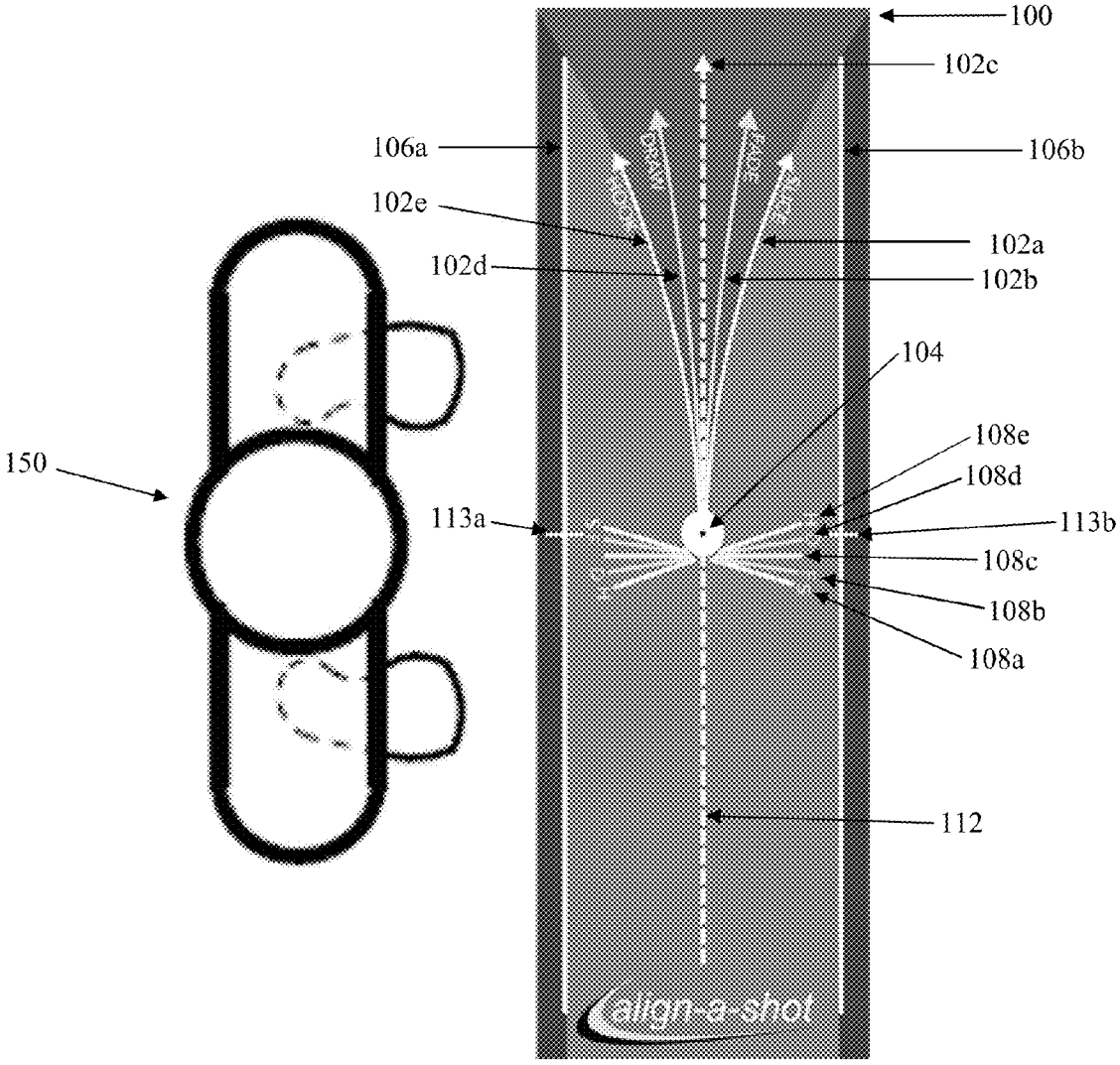
FIG. 1B shows an example of a player's position with respect to the visual guide.

FIG. 1B shows an example of a player's position with respect to the visual guide 100. The player's 150 feet, hips, and shoulders may be parallel with one or more outer alignment guides 106*a*, 106*b*. The player's feet may be the same distance from an alignment guide 106*a*, 106*b*. In some instances, a ball marker 104 may be provided in front of the player in the region between the player's feet. One or more shot type arrows 102*a*, 102*b*, 102*c*, 102*d*, 102*e* may be directed substantially toward a target. Depending on whether the player is right-handed or left-handed, the player may stand so that the shot type arrows are aimed to the player's left (e.g., if the player is right-handed) or are aimed to the player's right (e.g., if the player is left-handed). One or more clubface lines 108*a*, 108*b*, 108*c*, 108*d*, 108*e* may be provided behind a ball marker.

In accordance with an embodiment of the invention, a player may take one or more of the following actions in using the visual guide. The player may orient the visual guide so that a desired shot type arrow is aimed at a target. For example, if the player wishes to hit a draw, the player will rotate the entire device clockwise until a draw arrow 102*d* is pointing at a desired target. If the desired shot type arrow is already aimed at a target, the player need not reorient the visual guide.

The player may align his or her feet, hips, and shoulders parallel to the outer alignment arrows. Thus, the player may be oriented so that the player's stance is not parallel to the direction of the target (e.g., the direction of the selected shot type arrow), unless the player is trying to hit a straight shot.

The player may place the player's golf clubface on a clubface line (e.g., 108*a*, 108*b*, 108*c*, 108*d*, or 108*e*) which perpendicularly corresponds to the selected shot type arrow (e.g., 102*a*, 102*b*, 102*c*, 202*d*, 102*e*). For example, if the player wants to hit a draw, the player will place the player's clubface on the draw (D) club face line (108*d*).

The player may adjust the player's grip according to the type of shot. The player may adjust the strength and/or positioning of the grip. For example, the player may strengthen (close) the player's grip for draw, and/or weaken (open) the player's grip for a fade.

The player may adjust the player's lateral position relative to the ball marker 104, the outer ball center indicator guides 113*a*, 113*b* and/or the position of the ball relative to the player's feet. Such adjustment may occur based on the type of club that the player is using and the desired vertical trajectory (low, mid-height or high shots). In some instances, while the player is adjusting the player's lateral position, the player may remain in a parallel stance relative to an alignment guide 106*a*.

When practicing the swing, the player may swing straight back and forward through the center swing line 112. In some instances, depending on the type of shot, the clubface may or may not be orthogonal to the direction of the swing line when setting up the shot.

Thus, a player may set up the position of the visual guide and/or the player to accommodate the different types of shots, position of target, and/or types of club being used. While the visual guide position may vary depending on the type of shot, in some embodiments, the player's stance relative to the visual guide (e.g., an alignment guide of the visual guide) remains the same regardless of the type of shot being practiced.

Figure 2:
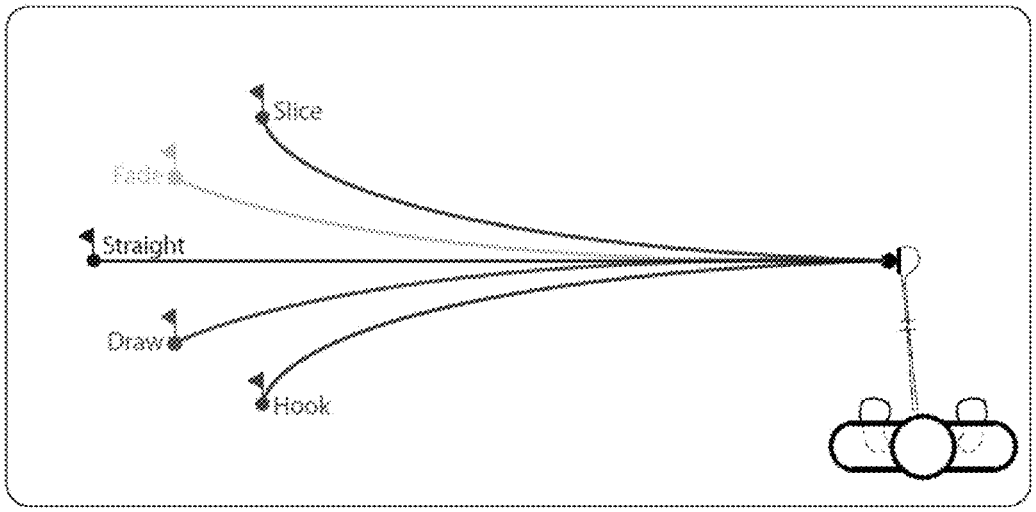
FIG. 2 provides an example of various types of shots resulting from golf swings.

FIG. 2 provides an example of various types of shots and ball flights that a device using a visual guide teaches the golfer how to achieve. These include a Straight shot where the trajectory of the ball is a straight line to the target. A Fade in which the golf ball starts off straight then curves gently to the right. Slice, a type of shot in which the ball starts out straight and then bends dramatically to the right. Draw, a shot type in which the golf ball starts out straight before curving gently to the left. Hook, a type of shot in which the ball starts out straight then bends dramatically left of the target.

Figure 3:
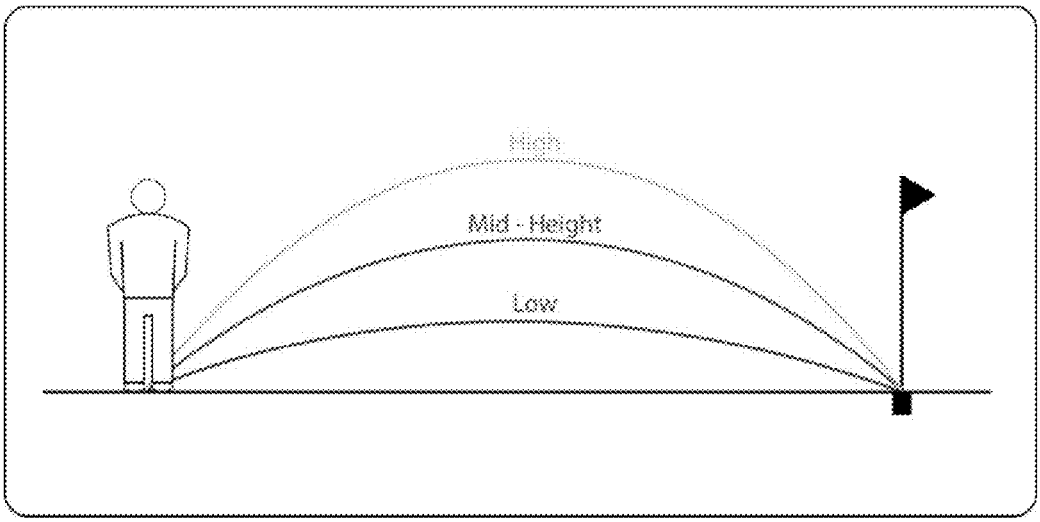
FIG. 3 provides an example of various vertical trajectories resulting from golf swings.

FIG. 3 provides an example of various vertical trajectories that a device using a visual guide teaches the golfer how to achieve in combination with selected shot type in FIG. 2. These include a Low shot where the vertical of trajectory of the ball is a low arc to the target. A Mid-Height shot where the vertical of trajectory of the ball is a medium arc to the target and a High shot where the vertical of trajectory of the ball is a high arc to the target.

The visual guide described herein may be useful as a training tool to permit the golfer to achieve the different types of shots. The visual guide may specifically provide a selected number of different shots to practice (e.g. high fade, mid-height fade, low fade, high straight, mid-height straight, low straight, high draw, mid-height draw, low draw, high hook, mid-height hook, low hook, high slice, mid-height slice, low slice). A golfer may make adjustment between different distinct shot types in order to practice any number of shot types between the selected indicators.

Depending on the type of shot that the golfer wishes to practice, the visual guide may be rotated relative to the target. Regardless of the type of shot, the golfer may have a parallel stance relative to an alignment indicator of the visual guide. Thus, depending on the type of shot, the golfer's stance may be rotated relative to the target. The golfer may swing straight through relative to the visual guide regardless of the type of shot.

Figure 4:
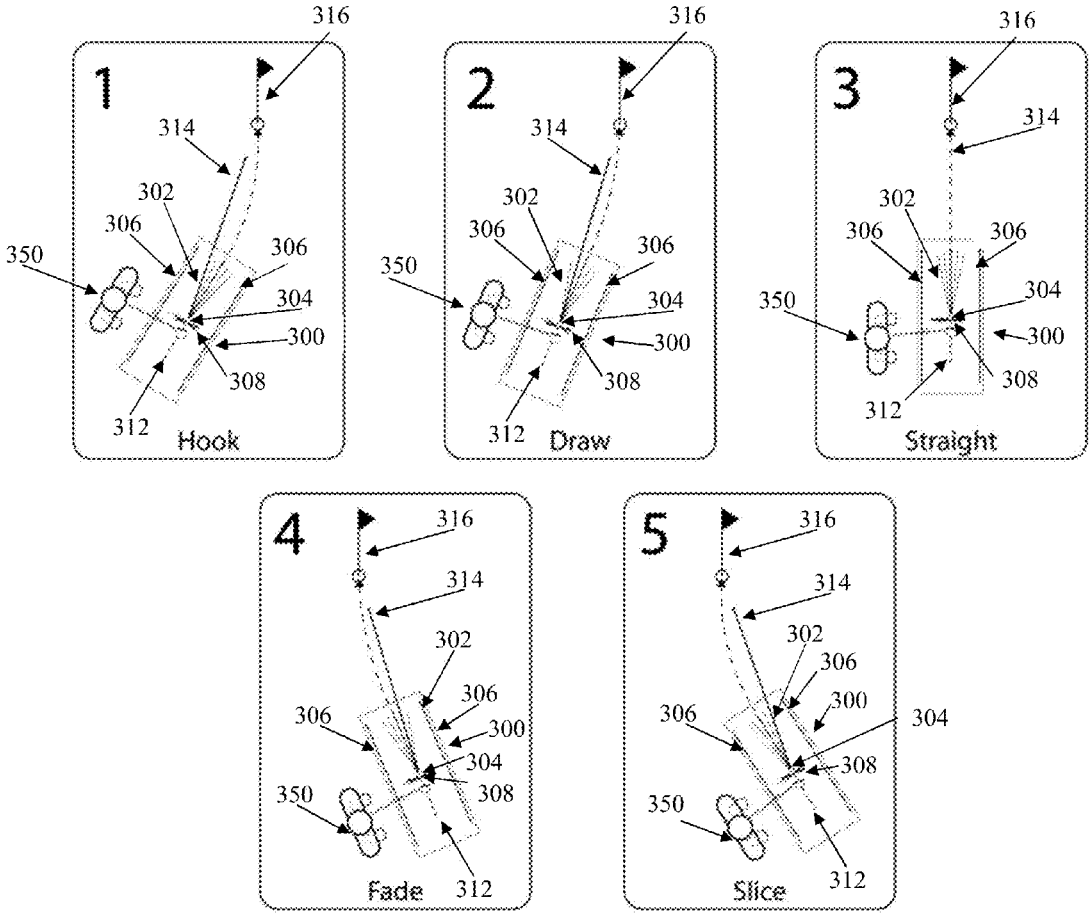
FIG. 4 provides an overview of how a visual guide can be used for different shot types, in accordance with an embodiment of the invention.

FIG. 4 provides an overview of how a visual guide can be used to achieve different shot types, in accordance with an embodiment of the invention. As depicted in FIG. 4 the device 300 having a visual guide is turned so the desired shot type arrow (straight, draw, fade, hook, slice) 302 is aimed 314 at the target 316. Thus, the device having a visual guide may or may not be oriented so that the length of the device is oriented to the target. The visual guide may have one or more alignment arrows 306 which may or may not be pointed directly at the target. The player's initial stance when setting up for a swing may be parallel to the one or more alignment arrows. The device may be oriented so that the player 350 stands at an angle to the target. The player may swing through a center swing line 312.

For example, if the golfer 350 wants to hit a hook as shown in FIG. 4(1), the golfer may rotate the entire device clockwise (e.g., twelve degrees), until the hook arrow 302 is pointing 314 at the desired target 316. A ball may be placed on a ball marker 304. The golfer then aligns feet, hips, and shoulders parallel to the outer alignment guides 306 which creates a closed stance relative to the intended target. The golfer may then place the golfer's clubface on the corresponding hook clubface line 308 which may set the golfer up with a closed clubface pointing at the target. The corresponding hook clubface line may be color coded to match the hook arrow. The golfer may then swing straight back and straight forward through the center swing line 312. The closed stance coupled with closed clubface and straight swing may create a left spin on the ball, causing the trajectory of the ball to start out in the direction of the swing path then bending left.

Inversely, if the golfer 350 wants to hit a slice as shown in FIG. 4(5), the golfer may rotate the entire device counterclockwise (e.g., twelve degrees), until the slice arrow 302 is pointing 314 at the desired target 316. A ball may be placed on a ball marker 304. The golfer then aligns feet, hips, and shoulders parallel to the outer alignment guides 306 which creates an open stance relative to the intended target. The golfer may then place the golfer's clubface on the corresponding slice clubface line 308 which may set the golfer up with an open clubface pointing at the target. The corresponding slice clubface line may be color coded to match the slice arrow. The golfer may then swing straight back and straight forward through the center swing line 312. The open stance coupled with open clubface and straight swing may create a right spin on the ball, causing the trajectory of the ball to start out in the direction of the swing path then bending right.

In another example, if the golfer 350 wants to hit a draw as shown in FIG. 4(2), the golfer may rotate the entire device clockwise (e.g., six degrees), until the draw arrow 302 is pointing 314 at the desired target 316. A ball may be placed on a ball marker 304. The golfer then aligns feet, hips, and shoulders parallel to the outer alignment guides 306 which creates a somewhat closed stance relative to the intended target. The golfer may then place the golfer's clubface on the corresponding draw clubface line 308 which may set the golfer up with a somewhat closed clubface pointing at the target. The corresponding draw clubface line may be color coded to match the draw arrow. The golfer may then swing straight back and straight forward through the center swing line 312. The somewhat closed stance coupled with somewhat closed clubface and straight swing may create a left spin on the ball, causing the trajectory of the ball to start out in the direction of the swing path then bending gently left.

Additionally, if the golfer 350 wants to hit a fade as shown in FIG. 4(5), the golfer may rotate the entire device counterclockwise (e.g., six degrees), until the fade arrow 302 is pointing 314 at the desired target 316. A ball may be placed on a ball marker 304. The golfer then aligns feet, hips, and shoulders parallel to the outer alignment guides 306 which creates a somewhat open stance relative to the intended target. The golfer may then place the golfer's clubface on the corresponding fade clubface line 308 which may set the golfer up with a somewhat open clubface pointing at the target. The corresponding fade clubface line may be color coded to match the fade arrow. The golfer may then swing straight back and straight forward through the center swing line 312. The somewhat open stance coupled with the somewhat open clubface and straight swing may create a right spin on the ball, causing the trajectory of the ball to start out in the direction of the swing path then bending gently right.

In some embodiments, if the golfer 350 wants to hit a straight shot as shown in FIG. 4(3), the golfer may position the entire device straight (e.g., zero degrees), until the straight arrow 302 is pointing 314 at the desired target 316. A ball may be placed on a ball marker 304. The golfer then aligns feet, hips, and shoulders parallel to the outer alignment guides 306 which creates a neutral stance relative to the intended target. The golfer may then place the golfer's clubface on the corresponding straight clubface line 308 which may set the golfer up with a neutral clubface pointing at the target. The corresponding straight clubface line may be color coded to match the straight arrow. The golfer may then swing straight back and straight forward through the center swing line 312. The neutral stance coupled with neutral clubface and straight swing may create little or no spin on the ball, causing the trajectory of the ball to travel straight along the swing path.

In some instances, the description provided for use of the device for different shots may apply to right-handed players. The description provided for use of the device may also apply to left-handed players. In some instances, the description of relative shot type arrows may be reversed for left-handed players.

Figure 5:
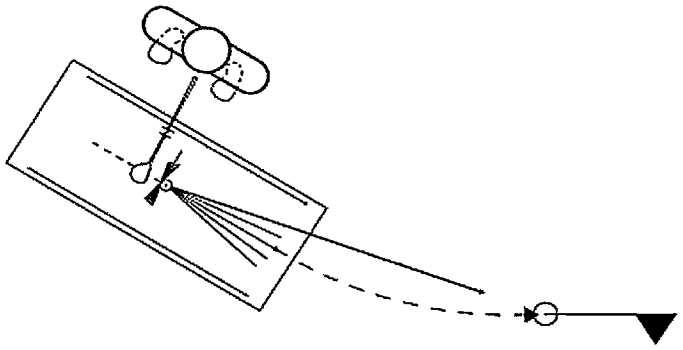
FIG. 5 provides an illustration of an example of a device useful for assistance in training golf swings.

FIG. 5 provides an illustration of an example of a device useful for assistance in training golf swings. The device may include a mat, rug or other object that may provide one or more visual cues useful for training golf swings. The device may include a visual guide, such as those described elsewhere herein. Unlike prior training apparatus, the devices provided in accordance with the concepts of the invention are frameless and do not require bulky rigid frames or protruding dowels. The graphical visual guides here provide a safe and convenient tool for golfers to practice.

The device may be designed to be portable. The device may have any dimensions. For example, the device may be 36 inches long by 24 inches wide. In some instances, one, two or more dimensions (e.g., length, width, diagonal) of the device may be greater than, less than, and/or equal to about 6 inches, 12 inches, 18 inches, 24 inches, 30 inches, 36 inches, 42 inches, 48 inches, or 54 inches. In some instances, the length of the device may be greater than the width. Alternatively, they may have the same dimensions.

The device may have any thickness. For example, the device may have a thickness greater than, less than, and/or equal to about 0.1 inches, 0.2 inches, 0.25 inches, 0.3 inches, 0.4 inches, 0.5 inches, 0.6 inches, 0.7 inches, 0.75 inches, 0.8 inches, 0.9 inches, 1 inch, 1.25 inch, 1.5 inch, or 2 inches. In some instances, the device does not require a separate frame or structured component.

In some instances, the device can be rolled up for easy transport. In alternate embodiments, the device may be folded, compressible, or collapsible. Optionally, the device may be rolled up to have no greater than inches, 10 inches, 8 inches, 6 inches, 4 inches, 3 inches, 2 inches, or 1 inch cross-sectional diameter. The device may include a flexible or bendable component. In some instances, the device may weigh less than or equal to about 3 kg, 2.5 kg, 2 kg, 1.5 kg, 1 kg, 0.75 kg, 0.5 kg, 0.3 kg, 0.2 kg, 0.1 kg, 0.05 kg, or 0.01 kg.

The device may be fabricated with a non-slip rubber base and low friction fabric top with said visual guide design applied to it. Other prototypes and future versions may be constructed with various materials. The device may have a bottom surface and an opposing top surface. The top surface may be exposed to a user's view when in use. The bottom surface may contact an underlying surface when in use. The bottom surface may have a higher frictional coefficient than the top surface. In some instances, the ratio of frictional coefficient of the bottom surface to the top surface may be greater than, less than, or equal to about 50:1, 40:1, 30:1, 20:1, 15:1, 10:1, 8:1, 6:1, 5:1, 4:1, 3:1, 2:1, 3:2, 4:3, or 5:4.

In some instances, the top surface may be formed from a different material as the bottom surface. The top materials and bottom materials may be mechanically connected to one another, adhered to one another, melted or melded into one another, or be affixed to one another in any manner. In some instances a top and/or bottom surface may include rubber, plastic, nylon, fabric, or any other material. The top and/or bottom surface may be designed to be compressible. In some instances, the top and/or bottom surfaces may be smooth, bumpy, contain grooves or indentations or protrusions, or one or more surface features. For example, a bottom surface may have gripping features to prevent slipping of the mat relative to the underlying surface.

The bottom surface may be designed to prevent slipping. The bottom surface of the mat may rest upon a surface upon which a user may desire practicing the user's golf swing. For example, the bottom surface of the mat may contact grass, pavement, turf, artificial/plastic grass mats, or any other material. In some embodiments, the device may rest upon a practice mat with artificial grass provided at a driving range.

The top surface may be designed to permit a user to swing a golf club over the top surface. The top surface may have a low friction top to permit the club to swing smoothly over the top surface. The top surface may be designed to simulate grass or other surfaces from which the user may wish to hit a golf ball. The top surface may or may not be designed to receive a ball that the user hits on top of the device. The surface may be configured so that the ball directly contacts the top surface when the user hits the ball, or may be configured to accept a tee, upon which a ball may rest.

In some instances, the visual guide may be displayed on the top surface of the device. The visual guide may be printed/painted on. The visual guide may have visually discernible different colors. The visual guide may or may not cause an interruption on the surface (e.g., may or may not protrude from or indented into the surface). Preferably the visual guide may be provided smoothly on the surface.

The device may be fully integrated in a single piece. In some instances, no separate pieces may need to be added to the device to indicate shot types. This may provide easy storage and transport. This may also simplify use of the device without requiring a user to attach or remove pieces. The device may or may not have separable portions.

In some embodiments, a user may bring the device to practice the user's golf swing. Alternatively, the device may already be provided at where the user is practicing the user's golf swing. A visual guide may or may not be integrated into another surface or device, such as practice hitting areas at a driving range. For instance, the user may bring a rolled up mat with the visual guide to a driving range. The user may unroll the mat and practice different types of shots with aid of the mat. The user may adjust the position of the mat according to the types of swings the user wishes to practice and the locations of the various targets. The user may practice the user's swing on the mat with or without a ball. The user may adjust the position of the mat and/or the user's stance while practicing various shots. When complete, the user may roll up the mat, take the mat and depart.

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. A golf shot training device, comprising:

a mat with a top surface comprising an area with a back region with a back end, a front region with a front end opposite the back end, an intermediate region, a reference swing axis extending longitudinally between the back and front ends, and opposite left and right reference sides relative to the reference swing axis;

a ball marker displayed on the intermediate region along the reference swing axis;

a plurality of five shot type arrows displayed on the front region of the top surface and each along a trajectory originating from a common point corresponding with the ball marker and diverging at different respective angles between them toward the front end;

wherein the five shot type arrows comprise a straight shot arrow that extends substantially straight along the reference swing axis, a draw shot arrow and a hook shot arrow that each diverges away from the straight shot arrow at increasing respective angles toward the front end on the left reference side, and a fade shot arrow and a slice shot arrow that each also diverges away from the straight shot arrow at increasing respective angles toward the front end on the right reference side;

a plurality of five straight, draw, hook, fade, and slice club face lines displayed on the top surface, and that have respective trajectories that intersect the reference swing axis at or behind the ball marker and at different respective angles that are each similarly orthogonal to the corresponding straight, draw, hook, fade, and slice shot arrows, respectively;

a single swing path along the reference swing axis and comprising the straight shot arrow in combination with a single swing line displayed on the back region, said single swing line comprising a substantially straight trajectory extending from the ball marker along the reference swing axis toward the back end and that is substantially co-linear with the straight shot arrow;

an alignment indicator displayed on the top surface and substantially parallel to the single swing path and configured to indicate a parallel golf stance for a golfer; and whereby adjusting an orientation of the mat between each of five different straight, draw, hook, fade, and slice alignment angles corresponding with each of the five respective shot type arrows pointing at a target, and adjusting an alignment of a golf club face between the five corresponding club face lines, respectively, the golfer is trained to hit a golf ball placed on the ball marker with each of five different corresponding straight, draw, hook, fade, and slice shaped shots toward the target by swinging a golf club with the same single swing path and with the same parallel golf stance relative to the corresponding alignment angle.

2. The device of claim 1 wherein the top surface is provided on a flexible mat that is capable of being rolled.

3. The device of claim 1 wherein at least one of said shot type arrows from said plurality is of a distinct color than at least one other shot type arrow from said plurality.

4. The device of claim 1 further comprising a bottom surface, wherein the bottom surface has a higher frictional coefficient than the top surface.

5. The device of claim 1 wherein the alignment indicator includes a pair of substantially parallel outer alignment guide lines, and wherein the single swing line in the back region behind the ball comprises a dashed center swing line that is in between and substantially parallel to the outer alignment guide lines.

6. A method for training a golfer to hit at least one of a plurality of five different straight, draw, hook, fade, and slice golf shots with a golf club at a target using a single swing and parallel golf stance oriented along a plurality of five different angled alignments relative to the target and corresponding with the five different golf shots, comprising:

providing a mat device with a top surface comprising an area with a back region with a back end, a front region with a front end opposite the back end, an intermediate region between the front and back regions, a reference swing axis extending longitudinally between the back and front ends, and opposite left and right reference sides relative to the reference swing axis;

displaying on the front region a plurality of five straight, draw, hook, fade, and slice shot type arrows corresponding with the straight, draw, hook, fade, and slice golf shots, respectively, and each along a trajectory originating from the ball marker and extending toward the front end;

wherein the straight shot type arrow extends substantially straight along the reference swing axis, the draw and hook shot type arrows diverge away from the straight shot type arrow at increasing respective angles toward the front end on the left reference side, and the fade and slice shot type arrows diverge away from the straight shot type arrow at increasing respective angles toward the front end on the right reference side;

displaying a ball marker on the intermediate region along the reference swing axis;

displaying on the intermediate region a plurality of five straight, draw, hook, fade, and slice club face lines that have respective trajectories that intersect the reference swing axis at or behind the ball marker and at different respective angles that are each similarly orthogonal to the corresponding straight, draw, hook, fade, and slice shot arrows, respectively;

displaying on the top surface a single swing path comprising the straight shot arrow in combination with a single swing line on the back region, wherein the single swing line comprises a substantially straight trajectory extending from the ball marker along the reference swing axis toward the back end and that is substantially co-linear with the straight shot arrow;

displaying an alignment indicator on the top surface and substantially parallel to the single swing path and configured to indicate a parallel golf stance relative to that single swing path for the golfer;

selecting a first shot type arrow according to a desired first golf shot to train the golfer;

orienting the mat device at a first alignment angle so that the selected first shot type arrow is aimed at the target;

with the mat device oriented at the first alignment angle, aligning the golfer's golf stance substantially parallel to the alignment indicator;

aligning a club face of a golf club with a selected first club face line corresponding with the first shot type arrow;

in the aligned parallel golf stance at the first alignment angle and with the club face aligned with the first club face line, swinging the golf club along the single swing path to hit a golf ball on the ball marker with the club face; and whereby the golfer is trained to hit the selected first golf shot.

7. The method of claim 6, further comprising:

selecting a second shot type arrow corresponding with a selected second golf shot to train the golfer;

orienting the mat device at a second alignment angle so that the selected second shot type arrow is aimed at the target;

with the mat device oriented at the second alignment angle, aligning the golfer's golf stance parallel to the alignment indicator;

aligning the club face of the golf club with a selected second club face line corresponding with the second shot type arrow; and in the aligned parallel golf stance at the second alignment angle and with the club face aligned with the second club face line, swinging the golf club along the single swing path to hit a golf ball on the ball marker with the club face; and whereby the golfer is trained to hit the first and second golf shots using the same single swing path and parallel golf stance relative to the first and second alignment angles, respectively, and by only changing the club face alignment between the first and second club face lines, also respectively.

8. The method of claim 6, further comprising:

training the golfer to hit each of the five different golf shots with the same single swing path and parallel golf stance relative to each of five different respective alignment angles for the mat device, respectively, corresponding with each of the five shot type arrows pointing to the target, also respectively, and by only changing the club face alignment between each of the five corresponding club face lines, also respectively.

* * * * *